US006402606B1

(12) United States Patent
Kusakabe et al.

(10) Patent No.: US 6,402,606 B1
(45) Date of Patent: Jun. 11, 2002

(54) GRINDING WHEEL HAVING URETHANE RESIN BUSHING IN ITS CENTER MOUNTING HOLE

(75) Inventors: Tsuguo Kusakabe, Okazaki; Ryuichi Nakane, Tsushima, both of (JP)

(73) Assignee: Noritake Co., Limited, Nagoya (JP)

( * ) Notice: Subject to any disclaimer, the term of this patent is extended or adjusted under 35 U.S.C. 154(b) by 0 days.

(21) Appl. No.: 09/690,394

(22) Filed: Oct. 19, 2000

(30) Foreign Application Priority Data

Oct. 25, 1999 (JP) ..... 11-301934

(51) Int. Cl.[7] ..... B23F 21/03

(52) U.S. Cl. ..... 451/541; 451/546; 451/544; 51/298

(58) Field of Search ..... 451/541, 542, 451/543, 544, 546, 547; 51/298, 299, 300

(56) References Cited

U.S. PATENT DOCUMENTS 4,035,161 A * 7/1977 Geissler et al.
5,079,875 A * 1/1992 Unno et al.
6,102,789 A * 8/2000 Ramanath et al. ..... 451/541

FOREIGN PATENT DOCUMENTS

JP 6-83258 11/1994

* cited by examiner

*Primary Examiner*—Eileen P. Morgan
(74) *Attorney, Agent, or Firm*—Oliff & Berridge, PLC

(57) ABSTRACT

A grinding wheel having a main body and a tubular bushing member which is fitted in an inner circumferential surface of a mounting hole formed through the main body, so that the grinding wheel is mounted on a wheel spindle of a grinding machine, with the bushing member being fitted on the wheel spindle. The bushing member includes an urethane resin as a main component thereof.

8 Claims, 3 Drawing Sheets

GRINDING WHEEL HAVING URETHANE RESIN BUSHING IN ITS CENTER MOUNTING HOLE

BACKGROUND OF THE INVENTION

1. Field of the Invention

The present invention relates in general to a grinding wheel having a center mounting hole at which the grinding wheel is to be mounted on a wheel spindle, and more particularly to such a grinding wheel having a bushing member fitted in an inner circumferential surface of the center mounting hole.

2. Discussion of the Related Art

There is known a generally disc- or cup-shaped grinding wheel having a mounting hole formed at a center thereof about which the grinding wheel is to be rotated. A wheel spindle of a grinding machine or a mounting member attached to the wheel spindle is fitted into the mounting hole, so that the grinding wheel is rotatable together with the wheel spindle. The wheel spindle or the mounting member, which is fitted in the mounting hole, tends to be worn due to its contact with abrasive grains which cooperate with a vitrified bond or an organic bond to constitute a vitrified abrasive structure or a resinoid abrasive structure of the grinding wheel. The wearing of the wheel spindle or mounting member causes deterioration of a coaxial or concentric relationship between the wheel spindle and the grinding wheel or between the mounting member and the grinding wheel, accordingly resulting in deteriorated machining accuracy of the grinding wheel.

There is also known a grinding wheel having a bushing member bonded to an inner circumferential surface of a central mounting hole formed therein. The bushing member consists of a layer of lead, sulfur or carbovidro bond which is prepared by adding graphite to sulfur. In the process of forming the bushing member, the lead, sulfur or carbovidro bond is first heated into a molten state, and the molten lead, sulfur or carbovidro is then poured into a suitable mold so that the molten material is hardened in the mold. The bushing member may consist of a layer of other material, such as a layer of gypsum which is prepared by pouring a slurry of gypsum into a mold, as disclosed in JP-U-06-83258. Such a grinding wheel having the bushing member provides an advantage that the wheel spindle or mounting member is prevented from being worn since the wheel spindle or mounting member is introduced into the no bushing member so as to be fitted in the bushing member without contact of the wheel spindle or mounting member with the abrasive grains.

However, the above-described bushing member does not have a sufficiently high strength, and is not bonded to a main body of the grinding wheel with a sufficiently high bonding strength. In addition, the bushing member made of lead cannot be easily formed due to rapid solidification of molten lead, particularly, where the main body of the grinding wheel has a relatively large outside diameter and the mounting hole has an accordingly large inside diameter, or where the main body of the grinding wheel has a relatively large axial length and the mounting hole has an accordingly large axial length. The bushing member made of sulfur or carbovidro bond suffers from a relatively large degree of chronological deterioration or aging, and does not have a sufficiently high degree of bonding strength with which the bushing member is bonded to the main body, resulting in a risk of cracking or separation of the bushing member from the main body, depending upon a condition in which the grinding wheel is stored. The bonding strength is further reduced, for example, where the abrasive grains have a grain size not larger than #240. The bushing member made of gypsum is difficult to be formed due to a relatively long time required for hardening the gypsum, and does not have a high degree of strength, resulting in a large risk of being cracked during a grinding operation.

SUMMARY OF THE INVENTION

It is therefore an object of the present invention to provide a grinding wheel having a bushing member which can be easily formed even where a mounting hole of the grinding wheel has a large diameter or a large axial length, and which has high degrees of durability and strength with a reduced degree of chronological deterioration and exhibits a high degree of bonding strength with respect to a main body of the grinding wheel.

Various studies made by the present inventors revealed that it is possible to easily form a bushing member by using an urethane resin as a material for the bushing member, and that the bushing member formed of the urethane resin has sufficiently high degrees of durability and strength and provides a sufficiently high degree of bonding strength with respect to the main body of the to grinding wheel.

Therefore, the above-described object may be achieved according to the principle of the present invention, which provides a grinding wheel having a main body and a tubular bushing member which is fitted in an inner circumferential surface of a mounting hole formed through the main body, so that the grinding wheel is mounted on a wheel spindle of a grinding machine, with the bushing member being fitted on the wheel spindle, wherein the bushing member includes an urethane resin as a main component thereof.

The urethane resin, which is used as the main or major component of the busing member of the present grinding wheel, has a relatively low viscosity before hardening thereof, so that the urethane resin is easily poured into a cavity of a mold which defines a desired shape of the bushing member, and permeates or enters into small cavities and pores of abrasive structure of the main body of the grinding wheel. The time required for hardening or curing the urethane resin is about two minutes, which is as short as that for hardening a sulfur. Thus, the bushing member is formed with a simple operation, even where the mounting hole has a large diameter and/or a large axial length, namely even where the bushing member is required to have a large diameter and/or a large axial length. The bushing member constituted by the hardened urethane resin has a high degree of durability with reduced chronological deterioration or aging, and a high degree of strength with which the bushing member is bonded to the main body.

According to a first preferred form of the grinding wheel of the invention, the urethane resin has a viscosity of 15–200 mPa·s (=15–200 c.p.s) before hardening thereof. Owing to the low viscosity, the urethane resin can be easily poured into the cavity of the mold, and the poured urethane resin can be distributed evenly in the entirety of the cavity of the mold and enters into the small cavities and pores of the abrasive structure of the main body of the grinding wheel, resulting in a further increased bonding strength.

According to a second preferred form of the grinding wheel of the invention, the urethane resin has a bending strength of 10–40 MPa and an elastic modulus of 8–25 GPa after hardening thereof. Such material characteristics of the urethane resin provides the bushing member with a high degree of impact or shock resistance and a suitable degree of strength, so that grinding wheel can be mounted on the wheel spindle of a grinding machine with high precision, and so that an impact or shock applied to the bushing member is absorbed by the bushing member, protecting the main body of the grinding wheel from the impact or shock.

According to a third preferred form of the grinding wheel of the invention, the urethane resin has a hardness ranging from D-50 to D-70 after hardening thereof. This hardness of the urethane resin makes it possible to smoothly introduce the wheel spindle into the bushing member, and minimize wear of the wheel spindle which is fitted into the bushing member.

According to a fourth preferred form of the grinding wheel of the invention, the main body consists of an abrasive structure in which abrasive grains are held together by a vitrified bond.

According to fifth preferred form of the grinding wheel of the invention, the bushing member has a wall thickness of 0.2–2.0 mm as measured in a radial direction thereof.

BRIEF DESCRIPTION OF THE DRAWINGS

The above objects, features and advantages of the present invention will be better understood by reading the following detailed description of presently preferred embodiment of the invention., when considered in connection with the accompanying drawings, in which.

DETAILED DESCRIPTION OF THE PREFERRED EMBODIMENT

Figure 1:
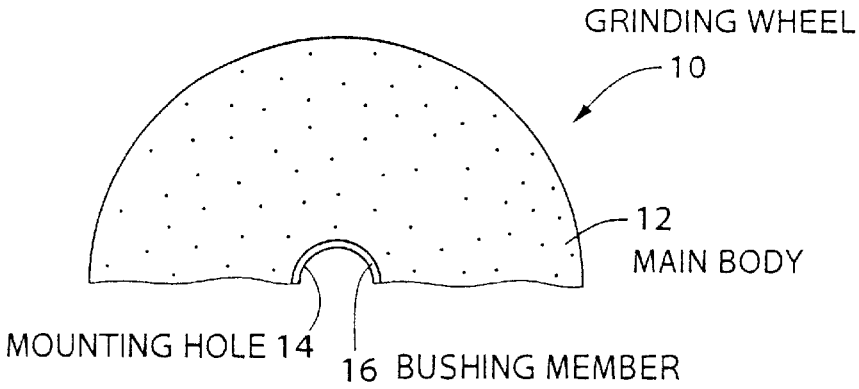
FIG. 1 is a front view of a portion of a grinding wheel with a busing member constructed according to one embodiment of this invention.

FIG. 1 shows a grinding wheel 10 which is constructed according to an embodiment of this invention. The grinding wheel 10 has a disk-shaped main body 12, a mounting hole 14 which is formed through a central portion of the main body 12 and extends in the axial direction of the main body 12, and a tubular busing member 16 which is made of an urethane resin and has a wall thickness of 0.2–2.0 mm as measured in the radial direction of the bushing member 16. The bushing member 16 is fixedly fitted in the inner circumferential surface of the mounting hole 14. The main body 12 of the grinding wheel 10 consists of an abrasive structure in which silicon carbide abrasive grains, molten alumina abrasive grains or other abrasive grains are held together by a vitrified bond or other inorganic bonding agent. That is, the main body 12 consists of a kind of vitrified grindstone, and is produced in a process which includes a step of mixing materials in the from of the abrasive grains, inorganic bonding agent and organic caking additive, a step of introducing the mixed materials into a mold of a desired disk shape and then compressing the materials in a press, and a step of firing or burning the materials at a temperature of 900–1200° C.

Figure 2:
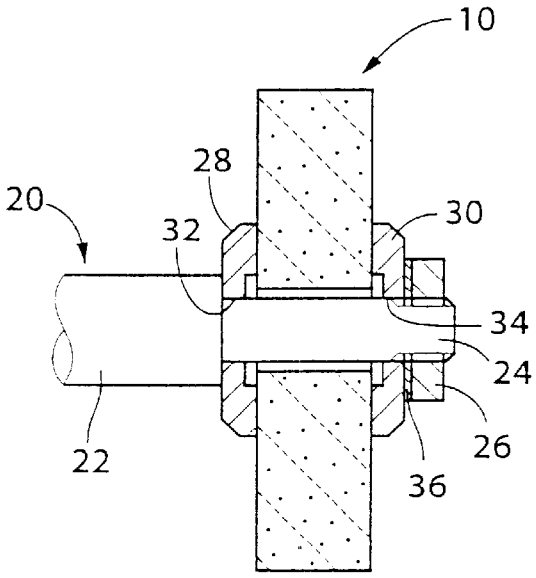
FIG. 2 is a view showing the grinding wheel of FIG. 1, when the grinding wheel is mounted on a wheel spindle of a grinding machine.

The grinding wheel 10 is mounted on a wheel spindle 20 of a grinding machine as shown in FIG. 2 by way of example. The wheel spindle 20 has a large diameter portion 22 and a small diameter portion 24 which is axially contiguous to the large diameter portion 22 and has an outside diameter smaller than that of the large diameter portion 22. The grinding wheel 10 is fitted at the busing member 16 onto the small diameter portion 24 of the wheel spindle 20, and is held at its central portion by and between a pair of holding flange members 28, 30 which are also fitted onto the small diameter portion 24 of the wheel spindle 20. The grinding wheel 10 is fixed to the wheel spindle 20, by tightening a nut 26 which is screwed onto an externally threaded, axially distal end part of the small diameter portion 24. One 28 of the holding flange members 28, 30 is held in contact with a shoulder surface of wheel spindle 20 which connects the outer circumferential surfaces of the respective large and small diameter portions 22, 24, while the other 30 of the holding flange members 28, 30 is held in contact with a washer 36, which prevents the nut 26 from being loosened. The holding flange members 28, 30 have respective center holes 32, 34 each of which has an inside diameter smaller than the outside diameter of the large diameter portion 22 and slightly larger than the outside diameter of the small diameter portion 24. A good fitting of the inner circumferential surface of the bushing member 16 with the outer circumferential surface of the small diameter portion 24 of the wheel spindle 20 provides a high degree of coaxiality or concentricity between the grinding wheel 10 and the wheel spindle 20. In this respect, the inside diameter of the busing member 16 is selected to be slightly lager than the outside diameter of the small diameter portion 24 of the wheel spindle 22 by a predetermined amount of about 0.1–0.3 mm.

Figure 3:
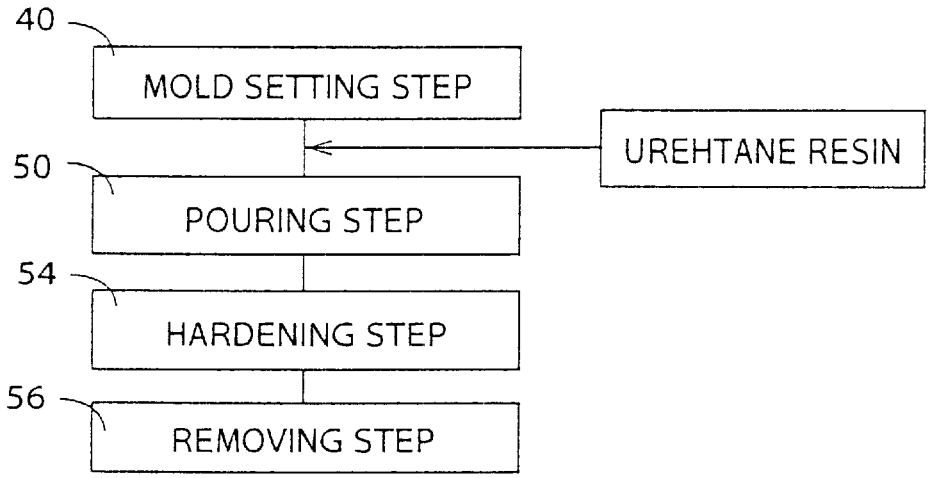
FIG. 3 is a flow chart explaining a process of forming the bushing member of the grinding wheel of FIG. 1.
Figure 4:
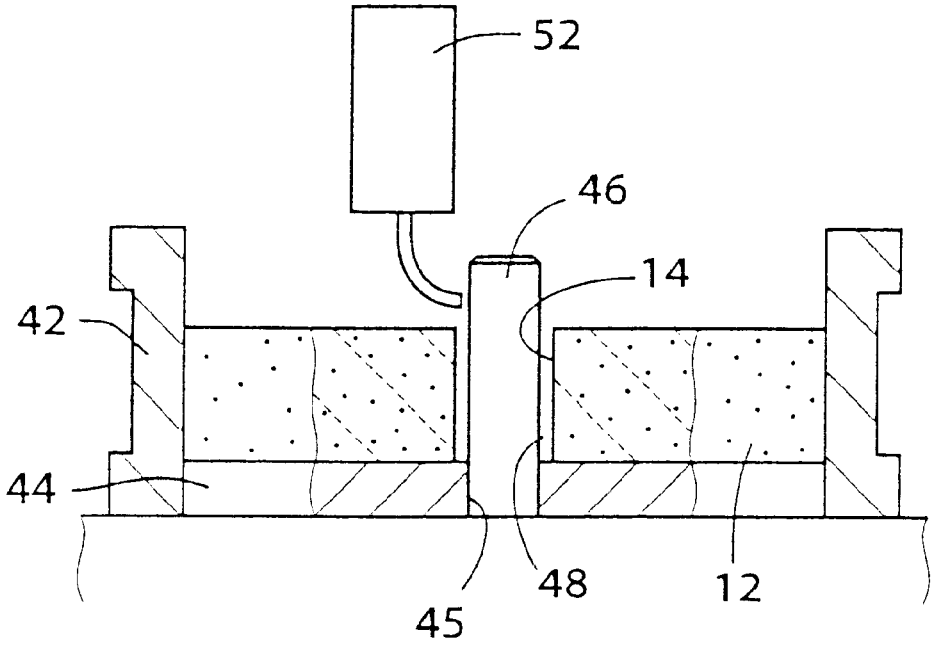
FIG. 4 is a view illustrating the process of FIG. 3.

The bushing member 16 of the grinding wheel 10 is formed, for example, in a process which includes a molding step 40, a pouring step 50, a hardening step 54 and a removing step 56, as shown in FIG. 3. The process is initiated with the molding step 40, in which the main body 12 of the grinding wheel 10 is first placed on a base plate 44, and the base plate 44 is then introduced into a frame 42 while a chrome shaft 46 is fitted at its axial end portion into a center hole 45 which is formed in a central portion of the base plate 44, such that the chrome shaft 46 extends through the mounting hole 14 of the grinding wheel 10 and is coaxially aligned with the main body 12 and the mounting hole 14 of the grinding wheel 10, with a tubular radial spacing 48 between the inner circumferential surface of the mounting hole 14 and the outer circumferential surface of the chrome shaft 46, as shown in FIG. 4. The inner circumferential surface of the mounting hole 14 and the outer circumferential surface of the chrome shaft 46 are radially spaced apart from each other by a predetermined radial distance of about 0.2–2.0 mm.

The molding step 40 is followed by the pouring step 50, in which an urethane resin is poured into the above-described radial spacing 48 by a dispenser 52 so that the radial spacing 48 is filled with the urethane resin. The urethane resin may be prepared by mixing two liquids and then defoaming or degassing the mixture, prior to the implementation of this pouring step 50. In the hardening step 54 which follows the pouring step 50, the urethane resin poured in the radial spacing 48 is exposed to the atmosphere at the ordinary temperature or a temperature up to about 60° C. for about 2–10 minutes, so that the urethane resin is hardened or cured so as to form the busing member 16. The hardening step 54 is followed by the removing step 56, in which the chrome shaft 46 is pulled out of the mounting hole 14 or the bushing member 16, and the grinding wheel 10 consisting of the main body 12 and the busing, member 16 is removed from the frame 42. Thus, the grinding wheel 10 as shown in FIG. 1 is formed.

The urethane resin forming the bushing member 16 contains a so-called urethane bond. A molecular weight of the urethane resin is about 1000–3000 when the urethane is not hardened. A viscosity of the urethane resin is as low as 10–100 mPa·s (=c.p.s) when the two liquids are mixed, i.e., before the hardening. After the hardening, the urethane resin has a bending strength ranging from 10 MPa to 40 MPa, an elastic modulus (Young's modulus) ranging from 8 GPa to 25 GPa, and a hardness (Shore hardness measured by a Shore hardness tester) ranging from D-50 to D-70.

An experiment was conducted by the present inventors, using a grinding wheel of sample 1 and a grinding wheel of comparative example 1, each of which has a main body having dimensions of ϕ510 mm (outside diameter)×180 mm (thickness)×ϕ254 mm (inside diameter or diameter of mounting hole) and consisting of a vitrified abrasive structure wherein that abrasive grains each having a size of #240 are held together by a vitrified bond or other inorganic bonding, agent. The grinding wheel of sample 1 has a bushing member which is formed of an urethane resin having a viscosity of 100 c.p.s before the hardening, in a process similar to the above-described process of FIG. 3. The grinding wheel of comparative example 1 has a bushing member which is formed of a carbovidro that is prepared by adding graphite to sulfur. The carbovidro is poured into a mold and then hardened so as to form the bushing member of the grinding wheel of comparative example 1.

In the experiment, both of the grinding wheels of sample 1 and comparative example 1 were heated such that the temperature was increased at a rate of 50 degrees per 10 hours. The busing member of the grinding wheel of comparative example 1 suffered from cracking due to heat applied thereto, while the bushing member of the grinding wheel of sample 1 suffered from neither cracking nor separation from the main body.

The urethane resin, which is used as a material to form the busing member 16 of the grinding wheel 10, can be hardened in about two minutes. That is, the required time for hardening the urethane resin is as short as that for hardening a sulfur. Thus, the bushing member 16 is easily formed in an easy operation, even where the mounting hole 14 has a large diameter and/or a large axial length. The bushing member 16 constituted by the hardened urethane resin has a high degree of durability with reduced chronological deterioration or aging, and a high degree of strength with which the bushing member 16 is bonded to the main body 12.

Further, the urethane resin used to form the bushing member 16 has a viscosity as low as 15–200 mPa·s(=c.p.s) before the hardening. Owing to the low viscosity, the urethane resin can be easily poured into the above-described radial spacing 48 defined by and between the outer circumferential surface of the chrome shaft 46 and the inner circumferential surface of the main body 12, and the poured urethane resin can be distributed evenly in the entirety of the radial spacing 48 and enters into even small cavities and pores of the abrasive structure of the main body 12, resulting in a further increased bonding strength.

After the hardening of the urethane resin, the bending strength thereof and the elastic modulus (Young's modulus) thereof are 10–40 MPa and 8–25 GPa, respectively, as described above. The material characteristics of the urethane resin provides the bushing member 16 with a high degree of impact or shock resistance and a suitable degree of strength, so that grinding wheel 10 can be mounted on the wheel spindle 20 of a grinding machine with high precision, and so that an impact or shock applied to the bushing member 16 is absorbed by the bushing member 16, protecting the main body 12 of the grinding wheel 10 from the impact or shock.

Further, the hardness (Shore hardness measured by a Shore hardness tester) of the urethane resin after the hardening ranges from D-50 to D-70, as described above. This hardness permits the small diameter portion 24 of the wheel spindle 20 to be smoothly introduced into the bushing member 16 of the grinding wheel 10, and minimizes wear of the small diameter portion 24 of the wheel spindle 20.

While the preferred embodiment of the present invention has been described above for illustrative purpose only, it is to be understood that the invention is not limited to the details of the illustrated embodiment.

While the bushing member 16 is constituted by only the urethane resin in the above-illustrated embodiment, the busing member 16 may include a color pigment, a filler, a modifier or other additive, in addition to the urethane resin as the main component.

While the grinding wheel 10 has the disk-shaped main body 12 whose outer circumferential surface serves as a grinding surface in the above-illustrated embodiment, the grinding wheel 10 may have a cup-shaped main body whose axial end surface face serves as a grinding surface.

It is to be understood that the present invention may be embodied with various other changes, modifications and improvements, which may occur to those skilled in the art, without departing from the spirit and scope of the invention defined by the following claims:

What is claimed is:

1. A grinding wheel having a main body and a tubular bushing member which is fitted in an inner circumferential surface of a mounting hole formed through said main body, so that said grinding wheel is mounted on a wheel spindle of a grinding machine, with said bushing member being fitted on said wheel spindle, wherein an improvement comprises:

said bushing member including a defoamed urethane resin as a main component thereof.

2. A grinding wheel according to claim 1, wherein said urethane resin has a bending strength of 10–40 MPa and an elastic modulus of 8–25 GPa.

3. A grinding wheel according to claim 1, wherein said urethane resin has a hardness ranging from D-50 to D-70.

4. A grinding wheel according to claim 1, wherein said main body consists of an abrasive structure in which abrasive grains are held together by a vitrified bond.

5. A grinding wheel according to claim 1, said bushing member has a wall thickness of 0.2–2.0 mm as measured in a radial direction thereof.

6. A process of forming the bushing member of the grinding wheel defined in claim 1, comprising:

a step of mixing liquids and defoaming a mixture of the liquids, so as to prepare said defoamed urethane resin as said main component of said bushing member.

7. A process according to claim 6, wherein said defoamed urethane resin is prepared such that said defoamed urethane resin has a viscosity of 15–200 mPa·s.

8. A process according to claim 7, further comprising a step of pouring said defoamed urethane resin into a cavity of a mold which defines a shape of said bushing member; and a step of hardening said urethane resin, by exposing said urethane resin to an atmosphere at a temperature not higher than 60° C.

* * * * *